US011084991B2

(12) United States Patent
Koseoglu

(10) Patent No.: US 11,084,991 B2
(45) Date of Patent: Aug. 10, 2021

(54) TWO-PHASE MOVING BED REACTOR UTILIZING HYDROGEN-ENRICHED FEED

(71) Applicant: SAUDI ARABIAN OIL COMPANY, Dhahran (SA)

(72) Inventor: Omer Refa Koseoglu, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/863,653

(22) Filed: Apr. 30, 2020

(65) Prior Publication Data

US 2020/0407652 A1 Dec. 31, 2020

Related U.S. Application Data

(60) Provisional application No. 62/898,268, filed on Sep. 10, 2019, provisional application No. 62/866,343, filed on Jun. 25, 2019.

(51) Int. Cl.
*C10G 67/14* (2006.01)

(52) U.S. Cl.
CPC ..... *C10G 67/14* (2013.01); *C10G 2300/1048* (2013.01); *C10G 2300/1059* (2013.01); *C10G 2300/1074* (2013.01); *C10G 2300/1077* (2013.01); *C10G 2300/202* (2013.01); *C10G 2300/205* (2013.01); *C10G 2300/308* (2013.01); *C10G 2400/00* (2013.01); *C10G 2400/06* (2013.01); *C10G 2400/16* (2013.01)

(58) Field of Classification Search
CPC ..... C10G 67/14; B01J 8/04; B01J 8/22
USPC ..... 208/56, 143, 157, 176; 585/250
See application file for complete search history.

(56) References Cited

U.S. PATENT DOCUMENTS 3,378,349 A 4/1968 Shirk
3,598,541 A 8/1971 Carson et al.
3,880,961 A 4/1975 Alcock
4,133,743 A * 1/1979 Boret ..... B01J 8/08 208/64
4,172,027 A * 10/1979 Ham ..... B01J 8/12 208/139
4,960,571 A 10/1990 Bhagat et al.
5,158,714 A 10/1992 Shih et al.
5,409,598 A * 4/1995 Kramer ..... B01J 8/008 208/113
5,484,578 A 1/1996 Muldowney et al.
5,837,208 A 11/1998 Grott et al.
(Continued)

OTHER PUBLICATIONS

Schmitz et al., "Deep Desulfurnization of Diesel Oil: Kinetic Studies and Process-Improvement by the Use of a Two-Phase Reactor With Pre-Saturator", Chem, Eng. Sci., 59, pp. 2861-2829, Jul. 2004 (Abstract only).

(Continued)

*Primary Examiner* — Nina Bhat
(74) *Attorney, Agent, or Firm* — Abelman, Frayne & Schwab

(57) ABSTRACT

A process for conversion of a liquid hydrocarbon feedstock in a moving bed hydroprocessing reactor is provided in which (a) hydrogen gas is dissolved in the liquid feedstock and (b) the mixture is flashed to remove and recover any light components, leaving a hydrogen-enriched feedstock. A homogeneous and/or heterogeneous catalyst is added to the feedstock upstream of the moving bed hydroprocessing rector.

20 Claims, 3 Drawing Sheets

(56) References Cited

U.S. PATENT DOCUMENTS

| | | | | |
|---|---|---|---|---|
| 5,849,976 | A * | 12/1998 | Gosling | B01J 8/12 585/709 |
| 5,942,197 | A | 8/1999 | Gupta et al. | |
| 6,270,654 | B1 | 8/2001 | Colyar et al. | |
| 7,414,167 | B2 * | 8/2008 | Kalnes | C07C 1/20 585/640 |
| 8,323,476 | B2 * | 12/2012 | Sadler | B01J 8/22 208/59 |
| 8,956,528 | B2 * | 2/2015 | Koseoglu | B01J 8/20 208/108 |
| 2008/0159928 | A1 | 7/2008 | Kokayeff et al. | |
| 2011/0147264 | A1 * | 6/2011 | Sadler | C10G 65/10 208/59 |
| 2013/0026068 | A1 * | 1/2013 | Koseoglu | C10G 47/26 208/85 |
| 2013/0126392 | A1 * | 5/2013 | Koseoglu | B01J 8/228 208/108 |
| 2014/0332444 | A1 * | 11/2014 | Weiss | C10G 65/04 208/88 |
| 2016/0369185 | A1 * | 12/2016 | Ward | C10G 65/12 |
| 2018/0215683 | A1 | 8/2018 | Koseoglu | |

OTHER PUBLICATIONS

International Search Report and Written Opinion dated Sep. 9, 2020 in corresponding International Patent Application PCT/US2020/038646.

* cited by examiner

TWO-PHASE MOVING BED REACTOR UTILIZING HYDROGEN-ENRICHED FEED

RELATED APPLICATIONS

This application claims priority to U.S. Provisional Patent Application No. 62/866,343 filed Jun. 25, 2019 and U.S. Provisional Patent Application No. 62/898,268 filed Sep. 10, 2019, the contents of which are both incorporated herein by reference in their entireties.

BACKGROUND OF THE INVENTION

Field of the Invention

This invention relates to hydrocracking, hydrotreating and/or hydroprocessing processes that employ moving bed reactors.

Description of Related Art

In a typical refinery, crude oil is initially introduced into an atmospheric distillation column or a crude tower where it is separated into a variety of components including naphtha boiling in the range of from 36° C. to 180° C., diesel boiling in the range of from 180° C. to 370° C., and atmospheric bottoms boiling above 370° C. The atmospheric bottoms, or residue, is further processed in a vacuum distillation column where it is separated into a vacuum gas oil (VGO) boiling in the range of from 370° C. to 520° C. and a heavy vacuum residue boiling above 520° C. The VGO can be further processed by hydrocracking to produce naphtha and diesel, or by fluid catalytic cracking (FCC) to produce gasoline and cycle oils. The vacuum residue can be treated to remove unwanted impurities and/or converted into useful hydrocarbon products.

In some cases, the atmospheric bottoms from the crude tower can be processed directly in processing units such as a resid FCC unit, hydroprocessing units, and coking units without first undergoing vacuum distillation. Hydroprocessing units include those used for hydrotreatment or hydrocracking.

Common objectives of hydroprocessing unit operations are to remove impurities such as sulfur, nitrogen and/or metals (particularly those in residue feedstocks), and cracking the relatively heavy hydrocarbon feedstock into relatively lighter hydrocarbons to obtain transportation fuels such as gasoline and diesel. The reactions that occur in hydroprocessing operations include hydrodemetallization (HDM), hydrodesulfurization (HDS), carbon residue reduction (CRR), hydrodenitrogenation (HDN), and hydrocracking.

Generally, the hydroprocessing reactions occur under operating conditions that include a temperature in the range of about 350°-460° C., preferably 350°-440° C., a pressure in the range of about 30-300 Kg/cm$^2$, preferably 100-200 Kg/cm$^2$, a liquid hourly space velocity (LHSV) in the range of about 0.1-10 h$^{-1}$, preferably 0.2-2 h$^{-1}$, and a hydrogen-to-oil ratio in the range of about 300-3000 L/L, preferably 500-1500 L/L.

Hydroprocessing is typically conducted in the presence of a catalyst containing metals from IUPAC Groups 6-10 of the Periodic Table such as tungsten, nickel, molybdenum and cobalt, in combination with various other porous particles such as alumina, silica, magnesia, titania or their combinations, that have a high surface-to-volume ratio. The catalysts utilized for hydrodemetallization, hydrodesulfurization, hydrodenitrogenation, and hydrocracking of heavy feedstocks include a carrier or base material, such as alumina, silica, silica-alumina, or crystalline aluminosilicate, with one or more catalytically active metals or other active compounds. Catalytically active metals typically include cobalt, nickel, molybdenum and tungsten; however, other metals or compounds can be used depending upon the application. The catalysts can be in the form of trilobes, quatralobes, cylinders or spheres.

In order to maximize refinery efficiency, downtime for replacement or regeneration of catalysts should be minimized. Furthermore, process economics generally require a versatile system capable of handling feed streams containing various types and quantities of contaminants including sulfur, nitrogen, metals and/or organometallic compounds, such as those found in VGO, deasphalted oils and residues.

There are three principal types of reactors used in the refining industry: fixed bed, ebullated bed and moving bed. A slurry bed reactor is another separate reactor technology that has operating characteristics that are similar to a moving bed. However, there are presently no commercial slurry bed unit operations.

In a fixed bed reactor, catalyst particles are stationary and do not move with respect to a fixed reference frame. Fixed-bed technologies are less suitable for treating relatively heavy feedstocks, particularly those containing high percentages of heteroatoms, metals, and asphaltenes, since these contaminants cause the rapid deactivation of the catalyst and subsequent plugging of the reactor. Multiple fixed-bed reactors connected in series can be used to achieve a relatively high conversion of heavy feedstocks boiling above 370° C., but such designs are costly to install and operate, and for certain feedstocks, particularly those containing metals, commercially impractical, because catalysts must be replaced every 3 to 4 months.

Ebullated bed reactors generally overcome the plugging problems associated with fixed-bed reactors and can be used for processing heavier feedstocks at increased rates of conversions and thereby reduce the recycle rate of the feed. In an ebullated bed reactor, the catalyst is in an ebullated state with random movement throughout the reactor vessel. The fluidized nature of the catalyst also permits on-line catalyst replacement of a predetermined percentage of the bed in order to maintain a high net activity for the bed that can be sustained at a relatively constant value over time.

Moving bed reactors combine certain advantages of fixed bed operations and the relative ease of catalyst replacement of the ebullated bed technology. Moving bed reactors also permit catalyst replacement without interrupting the continuous operation of the unit. Operating conditions are similar or slightly more severe than those typically used in fixed bed reactors, i.e., the pressure can exceed 200 Kg/cm$^2$, and the temperature can be in the range of from 380° C. to 430° C. During catalyst replacement, catalyst movement is slow compared to the linear velocity of the feed. The frequency of catalyst replacement depends on the rate of catalyst deactivation. Catalyst addition and withdrawal are performed, for example, via a sluice system at the top and bottom of the reactor, respectively. The advantage of the moving bed reactor is that the top layer of the moving bed consists of fresh catalyst, and contaminants deposited on the top of the bed move downward with the catalyst and are released during catalyst withdrawal at the bottom. Liquid feedstock and hydrogen gas can be introduced either at the top of the reactor to flow concurrently with, or into the bottom of the reactor to flow counter-currently against the downward movement of the catalyst. The tolerance to metals and other contaminants is therefore much greater than in a fixed bed reactor. With this capability, the moving bed reactor has advantages for the hydroprocessing of very heavy feeds, especially when several reactors are combined in series. Moving bed reactors can be used to advantage with feedstocks having a high concentration of metals at levels that cannot be efficiently processed in fixed bed reactors.

The amount of hydrogen in solution is affected, in part, by the type of reactor. For example, the catalyst in moving bed reactors undergoes a change in temperature ($\Delta T$) in the range of from 25° C. to 40° C. along the vertical axis of the reactor bed. In contrast, there is a minimal $\Delta T$ in slurry bed reactors that is typically in the range of from 1° C. to 2° C. There are relatively higher pressure drops in moving bed reactors due to the closely packed nature of the bed, in contrast to the lower pressure drops in slurry bed reactors.

In moving bed reactors, the catalyst is freshest and therefore most active at the top of the reactor and its activity is continuously reduced as it moves downwardly to the bottom of the reactor. The desired conversions of compounds containing sulfur, nitrogen and metals in the feedstock occur at or near the location where the feedstock is introduced into the catalyst bed. When hydrogen is injected at the bottom of the reactor where the catalyst is least active, the reactions are slower and their rate will improve as the hydrogen and feedstock move towards top of the reactor and the fresher more active catalyst. This effect is a clear advantage of moving bed reactors.

The decision to use a particular type of reactor is based on a number of criteria including the type of feedstock, the desired conversion percentage for a given reactor, the flexibility, run length and product quality, among others. In a refinery, the down-time for replacement or renewal of catalyst must be as short as possible. In addition, the economics of the process will generally depend upon the versatility of the system to handle feed streams containing varying amounts of contaminants such as sulfur, nitrogen, metals and/or organometallic compounds found in VGO, DAO and residues.

A typical moving bed reactor of the prior art operates as a three-phase system, i.e., gaseous hydrogen, the liquid feedstock and the solid heterogeneous catalyst. However, it is known that substantial amounts of hydrogen gas customarily present in conventional moving bed reactors cause problems including gas hold-up and non-uniformities of liquid-catalyst contact. The presence of hydrogen gas also reduces the efficiency of the liquid/catalyst contact and the wetting of the catalyst by the reactor liquid hydrocarbon, and also limits the hydrogen partial pressure. Additional problems can be associated with the presence of gas in the reactor effluent and bottoms streams.

Although there are numerous types of moving bed reactor designs, the problem persists of providing a more efficient and effective moving bed reactor system in order to improve reactor performance and to thereby enable the recovery of products of enhanced quality at less expense than is possible using current reactor systems and methods.

SUMMARY OF THE INVENTION

The desired benefits and other advantages of a process and system for conversion of liquid hydrocarbon feedstocks into lower molecular weight hydrocarbon compounds in a moving bed reactor are achieved in accordance with the present process improvement in which the gas-phase hydrogen is substantially eliminated by dissolving the hydrogen in the liquid feedstock prior to its introduction into the moving bed reactor, resulting in a single reactant phase, i.e., the liquid phase comprising the hydrocarbon feed and dissolved hydrogen, and a two-phase system i.e., the liquid reactant phase and a solid catalyst phase.

As discussed above, gas and liquid hold-up rates are important process parameters that can contribute to the efficient performance of the system. High gas hold-up rates of prior art systems result in decreased liquid/catalyst contacting efficiency and wetting which lowers process efficiency and performance. One of the principal advantages of the integrated system and process of the present disclosure is minimizing gas hold-up by dissolving a substantial portion of the requisite reaction hydrogen gas in the liquid feedstock to produce a combined hydrogen-enriched liquid phase feedstock. In addition, problems encountered in typical moving bed hydroprocessing reactors associated with a reduction in efficiency of the recycle pump due to the presence of gas in the recycle stream are minimized or obviated using the integrated system and process as described in more detail below. It is to be understood that the amount of hydrogen that can be dissolved in the feedstock, i.e., the hydrogen solubility, is dependent upon a number of factors including the composition of the hydrocarbon feed and the pressure and the temperature of the system. Each of these factors comprise the "predetermined conditions" referred to in the description of the process that follows and in the claims.

The process includes the steps of:

a. mixing the liquid hydrocarbon feedstock and an excess of hydrogen gas in a mixing/distribution zone under predetermined conditions of temperature and hydrogen partial pressure to dissolve a portion of the hydrogen gas in the liquid hydrocarbon feedstock to produce a mixture of hydrogen-enriched liquid hydrocarbon feedstock and undissolved hydrogen gas;
b. introducing the mixture of step (a) into a flashing zone under predetermined conditions to separate undissolved hydrogen gas and any light hydrocarbon components present from the feedstock and recovering a hydrogen-enriched liquid hydrocarbon feedstock;
c. introducing the hydrogen-enriched liquid hydrocarbon feedstock from the flashing zone into a reaction zone containing at least one moving bed reactor with at least one solid catalyst or catalyst precursor and reacting the feedstock to convert at least a portion of the feedstock into lower boiling point hydrocarbons;
d. recovering a liquid reactor effluent stream comprising converted hydrocarbon products from the moving bed reactor;
e. introducing the reactor effluent into a separation zone to separate converted hydrocarbon products from unconverted liquid effluent;
f. recovering the converted hydrocarbon products from the separation zone; and
g. recovering the unconverted liquid effluent from the separation zone.

In an embodiment of the system and process of the present disclosure, at least a portion of the treated, but unconverted liquid feedstock that is recovered from the moving bed reactor is recycled to constitute a portion of the liquid hydrocarbon feedstock.

In an embodiment of the system, the hydrocracking zone includes a plurality of reactors operating in series, preferably on a continuous basis, e.g., from two to six reactors, and in certain embodiments from two to four reactors.

In additional embodiments of the invention, an interstage separator is positioned to receive and process the unconverted reactor effluent between at least two of a plurality of the reactors and preferably between each pair of adjacent reactors, e.g., in systems where three or more reactors are operated in series.

In an embodiment where a plurality of reactors is operated in series, a hydrogen mixing/distribution zone and flashing zone are positioned downstream of at least one of the reactors, and preferably downstream of each pair of reactors, where more than two reactors are arranged in series.

In the embodiment in which there is only one reactor, a portion of the liquid product stream from the reactor is recovered and mixed with the unconverted liquid feedstock and is recycled for mixing with fresh feedstock for absorption of hydrogen gas, flashing and subsequent introduction into the reactor. This recycling of product increases the hydrogen adsorption capacity of the liquid feedstock due to the presence of lighter hydrocarbons that were converted in the reactor.

In the embodiment in which there are a plurality of reactors, a portion of the treated and unconverted liquid effluent from one or more of the reactors is recycled and mixed either with fresh or treated and unconverted feedstock for eventual hydrogen saturation and subsequent introduction to the same or an upstream reactor, to thereby supplement the amount of dissolved hydrogen in the feedstock entering the one or more downstream reactors. As used in connection with the embodiment employing a plurality of reactors in series, "recycle stream" means that portion of the unconverted liquid effluent from a reactor that is subsequently treated in a downstream reactor.

Other aspects, embodiments, and advantages of the process of the present invention are described in detail below. Moreover, it is to be understood that both the foregoing information and the following detailed description are merely illustrative examples of various aspects and embodiments that are intended to provide an overview or framework for understanding the nature and character of the system and of the process improvements. The accompanying drawings provide schematic illustrations of representative process steps and unit operations to facilitate an understanding of the various aspects and embodiments of the invention. The drawings, together with the remainder of the specification, also serve to explain principles and operations of the described and claimed aspects and embodiments of the present disclosure.

BRIEF DESCRIPTION OF THE DRAWINGS

The invention will be described in further detail below and with reference to the attached drawings in which the same numerals are used to refer to the same or similar elements, and where.

DETAILED DESCRIPTION OF PREFERRED EMBODIMENTS

In accordance with the improved process of the invention, all or a substantial portion of the hydrogen required for hydroprocessing/hydrocracking reactions conducted in a moving bed reactor, or series of reactors, is dissolved in the liquid hydrocarbon feedstock upstream of the moving bed reactor in a hydrogen mixing zone to produce a hydrogen-enriched feedstock. In one embodiment, a hydrogen distribution vessel upstream of the moving bed reactor receives hydrogen, fresh feedstock and, optionally, recycled product that has passed through a downstream reactor, and the liquid is saturated under predetermined conditions of pressure and temperature to dissolve at least a substantial portion of the requisite hydrogen gas in the liquid hydrocarbon feedstock, or combined feedstock, to produce a hydrogen-enriched liquid feedstock with dissolved hydrogen as a single-phase feedstream to the moving bed reactor.

Gas phase hydrogen is eliminated or substantially minimized by dissolving the hydrogen in the liquid hydrocarbon feedstock and flashing the feedstock under predetermined conditions of temperature and pressure upstream of the moving bed hydroprocessing unit to produce a single reactant phase of liquid hydrocarbon feedstock containing dissolved hydrogen, preferably at the saturation level at the prevailing temperature and pressure conditions. The predetermined conditions in the flashing zone depend on the hydrogen solubility of the feedstock. The hydrogen solubility is a function of pressure and temperature. Feedstocks that have different hydrogen solubility will require the flashing zone to be operated at different predetermined conditions, as will be understood by those skilled in the art. The predetermined operating conditions of the flashing zone are also selected with reference to the corresponding downstream operating conditions in the moving bed reactor into which the hydrogen-enriched liquid feed is introduced in order to avoid or minimize the release of hydrogen and to thereby maintain the level of dissolved hydrogen.

The moving bed system will therefore be operated as a single-phase liquid system having requisite hydrogen gas dissolved therein when one or more homogeneous liquid catalysts are employed, or as a two-phase system of liquid having requisite hydrogen gas dissolved therein and solid components when solid heterogeneous catalysts are employed.

For the purpose of the simplified schematic illustrations and this description, the numerous valves, pumps, temperature sensors, electronic controllers and the like that are customarily employed in refinery operations and that are well known to those of ordinary skill in the art are not shown in the interest of clarity.

Figure 1:
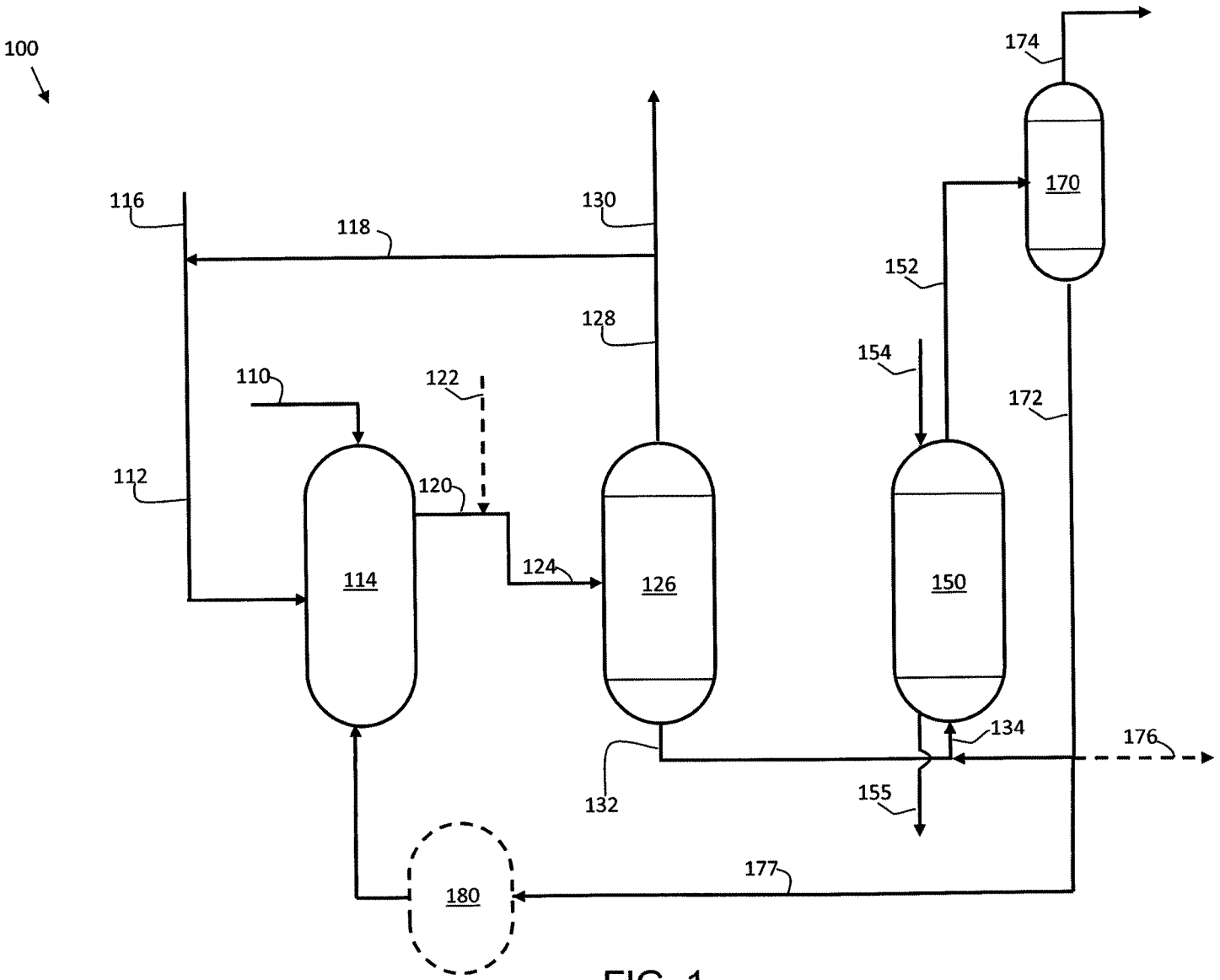
FIG. 1 is a schematic diagram of a system incorporating dissolved hydrogen in a feedstock upstream of a moving bed hydrocracking unit in accordance with the present disclosure.

Referring to FIG. 1, the process flow diagram is illustrative of a moving bed hydrocracking process of the present disclosure that includes a hydrogen-enriched feedstock. In general, system 100 includes:

a mixing/distribution zone 114, referred to herein as the mixing zone, having at least one inlet for receiving a fresh liquid hydrocarbon feedstock 110 and at least one inlet for receiving a hydrogen gas stream 112 or, alternatively, a combined inlet for receiving both the feedstock and hydrogen gas via, e.g., an in-line mixing device and an outlet for discharging a mixed or combined stream 120;

a flashing zone 126 having an inlet in fluid communication with the outlet discharging combined stream 120, a gas outlet 128 in fluid communication with one or more hydrogen gas inlets of the mixing zone 114, and an outlet for discharging hydrogen-enriched liquid feedstock 132;

a moving bed reaction zone 150 having an inlet in fluid communication with the hydrogen-enriched liquid feedstock outlet 132 of flashing zone 126, and an outlet 152; and a separation zone 170 having an inlet in fluid communication with the outlet 152 of the moving bed reaction zone 150, an outlet for discharging bottoms 172 for recycling through the system 100 and a product outlet for discharging light gases and recovering converted liquid products 174.

During operation of system 100, liquid hydrocarbon feedstock stream 110 is intimately mixed with the hydrogen gas stream 112 in mixing zone 114 under predetermined conditions of temperature and pressure to dissolve hydrogen gas in the liquid mixture and produce a hydrogen-enriched liquid hydrocarbon feedstock. The hydrogen gas stream 112 includes fresh hydrogen introduced via stream 116 and a recycled hydrogen stream recovered from the flashing zone 126 introduced via line 118. Combined stream 120, which includes the hydrogen-enriched feedstock and the remaining excess hydrogen gas, is optionally combined with catalyst 122. Catalyst 122 is fresh homogeneous catalyst and is separate from catalyst 154 of the moving bed reaction zone 150, which is a heterogeneous catalyst. The combined stream 124 is conveyed to the flashing zone 126 in which the undissolved hydrogen and other gases present, e.g., light feedstock fractions, are flashed off and removed as stream 128.

A portion of stream 128 is recycled via line 118 and mixed with the fresh hydrogen feed 116. The amount of recycled hydrogen in the hydrogen gas stream 112 generally depends upon a variety of factors relating to the excess undissolved hydrogen recovered from the flashing zone 126, and is preferably minimized by controlling upstream systems. The remaining portion of the flashed gases are removed from the system as a bleed stream 130, e.g., to prevent a build-up of light hydrocarbon gases in the system.

Figure 2B:
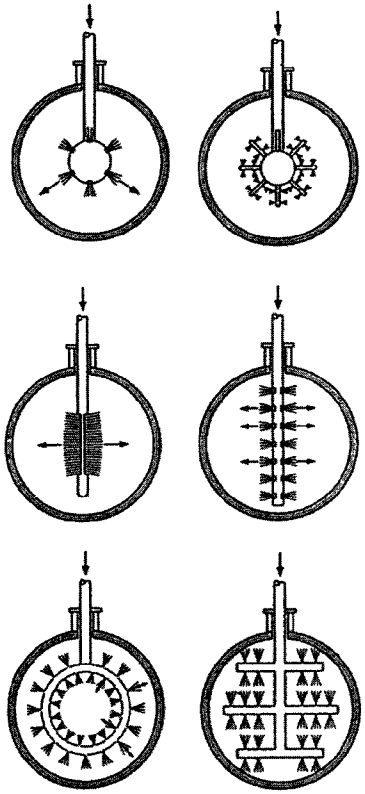
FIG. 2B PRIOR ART
FIG. 2B are schematic illustrations of gas diffusers of the prior art suitable for use in the system of FIG. 2A.

The mixing zone 114 described in FIG. 1 can include any apparatus that achieves the necessary intimate mixing of the liquid and gas to effectively saturate the hydrocarbon feedstock with dissolved hydrogen at the predetermined system operating temperature and pressure. In other embodiments, the mixing zone can include a combined inlet for the hydrogen and the feedstock. Effective unit operations include one or more gas-liquid distributor vessels, which apparatus can include spargers, injection nozzles, and other devices that impart sufficient velocity to inject the hydrogen gas into the liquid hydrocarbon with turbulent mixing and thereby promote hydrogen saturation. Suitable that are well known in the art are described with reference to FIGS. 2A and 2B, and other examples are described in U.S. Pat. Nos. 3,378,349; 3,598,541; 3,880,961; 4,960,571; 5,158,714; 5,484,578; 5,837,208; and 5,942,197, the relevant portions of which are incorporated herein by reference.

The hydrogen-enriched hydrocarbon feedstock 132 which contains a predetermined quantity of dissolved hydrogen, preferably at the saturation level, is optionally combined with a recycle stream 172, which are the bottoms from separation zone 170. The combined stream 134 is introduced into the moving bed reaction zone 150. In certain embodiments, not shown, hydrogen can be added to recycle stream 172 at a predetermined flow rate to saturate the recycle stream 172.

Fresh or regenerated catalyst 154 is introduced into the top of moving bed reaction zone 150. Partially or fully spent catalyst 155 is withdrawn from the lower portion of the moving bed reaction zone 150 in direct proportion to the amount of fresh catalyst 154 introduced at the top of the reaction zone.

The catalyst 154 can comprise active metals in the range of from 0.1 W % to 30 W % based on the total weight of the catalyst. The metals can be contained in a single or in combined metal systems. The catalyst can have a bulk density in the range of from 0.4 kg/L to 0.9 kg/L and a crush strength in the range of from 1 Kg/mm to 4 Kg/mm. The catalyst can have a total pore volume in the range of 0.30 cc/g to 1.50 cc/g and an average pore diameter in the range of from 50 Å to 900 Å. The total surface area of the catalyst can be in the range of 100 $m^2/g$ to 450 $m^2/g$.

The catalyst 122 can be a homogeneous catalyst that is an oil soluble organo-metal catalyst. An example of a catalyst that is appropriate for use as catalyst 122 is molybdenum acetylacetonate.

The reactor effluent stream 152 from the moving bed reaction zone 150 is introduced into separation zone 170. The light gases and converted liquid products stream 174 is recovered from the separation zone and at least a portion of bottoms 172 are recycled to the reaction zone 150 via mixed stream 134. Optionally, a portion 176 of the bottoms 172 is purged from the system 100. Optionally, a portion 177 of bottoms 172 is recycled to hydrogen mixing/distribution zone 114. An optional recycle surge vessel 180 can be located upstream the mixing/distribution zone 114.

In one embodiment, the liquid effluent 152 from the reactor 150 is sampled 156 and analyzed for dissolved hydrogen content. If little or no hydrogen remains in the effluent, it is sent to the mixing zone 114 via stream 177. If a predetermined minimum amount of hydrogen is present in the effluent, it is recycled to the reactor 150. The predetermined minimum amount of hydrogen is dependent on the liquid properties. Bottoms 172 may also contain dissolved hydrogen not reacted in the process. In certain embodiments, not shown, hydrogen can be added to recycle stream 172 at predetermined flow rates to saturate the recycle stream 172.

Separation zone 170 is illustrated as a single unit for simplicity. However, in certain embodiments separation zone 170 can include a plurality of separation vessels as are typically found in hydroprocessing systems, such as high pressure separation vessels, low pressure separation vessels, distillation vessels, flash vessels and/or stripping vessels. If hydrogen is stripped, the bottoms can be subjected to a hydrogen mixing step (not shown) prior to being recycled.

Figure 2A:
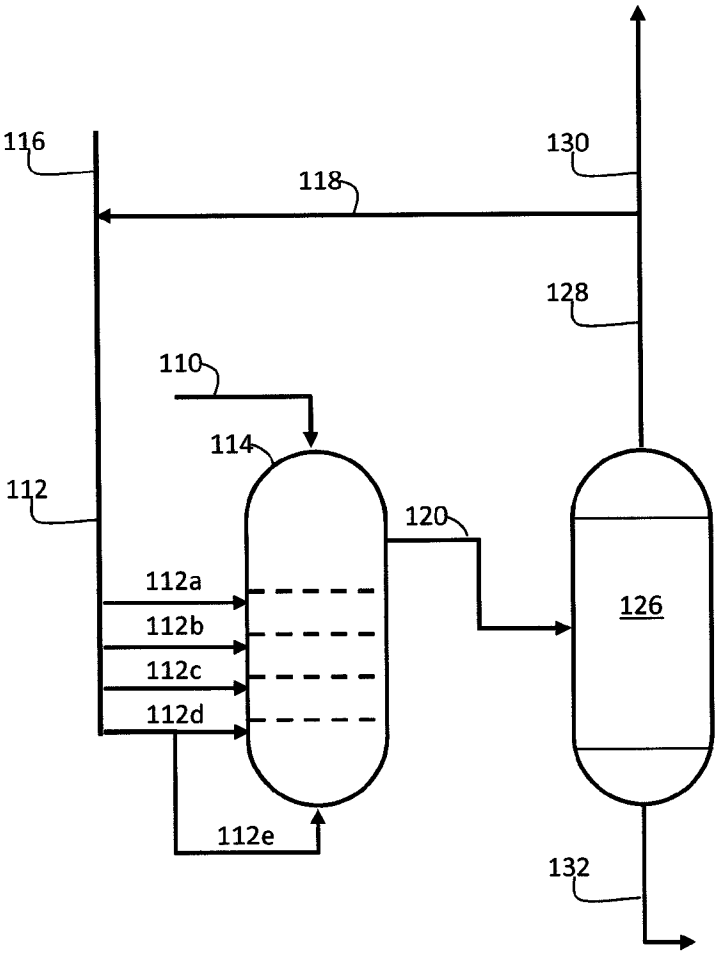
FIG. 2A PRIOR ART
FIG. 2A a schematic diagram of a hydrogen dissolving/adsorption system of the prior art suitable for use with the method and apparatus of FIG. 1.

In certain embodiments, such as, for example, that is shown in FIG. 2A, a column is used as a hydrogen distribution vessel 114, in which hydrogen gas 112 is injected at multiple locations 112*a*, 112*b*, 112*c*, 112*d* and 112*e*. Hydrogen gas is injected through hydrogen distributors into the column for sufficient mixing to efficiently dissolve the hydrogen and saturate the feedstock. For instance, suitable injection nozzles can be provided proximate several plates, e.g., locations 112*a* through 112*d* and also at the bottom of the column, i.e., location 112*e*. The liquid hydrocarbon feedstock 110 can either be fed to the top of the column as shown in the FIG. 2A or introduced at the bottom of the column (not shown).

Various types of hydrogen distribution devices can be used. Referring to the examples schematically illustrated in FIG. 2B, gas distributors can include tubular injectors fitted with nozzles and/or jets that are configured to uniformly distribute hydrogen gas into the flowing hydrocarbon feedstock in a column or vessel in order to achieve a state of saturation in the mixing zone or vessel 114.

Operating conditions in the mixing zone 114 are selected to achieve the desired level of solubility of the hydrogen gas in the liquid hydrocarbon mixture. The mixing zone is maintained at a pressure ranging from about 50-300 $Kg/cm^2$, in certain embodiments, 100-250 $Kg/cm^2$, and in further embodiments 150-200 $Kg/cm^2$. The mixing zone is maintained at a temperature in the range of from 300° C.-550° C., and in certain embodiments 350° C.-500° C., and in further embodiments 375° C.-450° C. Hydrogen is introduced into the mixing zone at a hydrogen-to-oil ratio of up to about 2500 lt/lt, in certain embodiments from 100 to 2500 lt/lt, and in further embodiments 200 to 500 lt/lt.

In certain embodiments, the amount of hydrogen added to the system is the same amount of hydrogen that is consumed in the reaction, minus inherent process losses that are well known to those skilled in the art such as mechanical losses in the compressors. For example, if the hydrogen consumption is 35 lt/lt, then the hydrogen-to-oil ratio is at least about 35 lt/lt.

The flashing zone 126 can include one or more flash drums that are operated under conditions to maintain the desired predetermined concentration of hydrogen gas in the liquid hydrocarbon feedstock under the conditions prevailing downstream in the moving bed reaction zone 150.

In an alternative embodiment (not shown), the flashing zone 170 can be eliminated and the feed is saturated by direct addition of the predetermined volumetric flow rate at, or upstream of the reaction zone inlet.

Figure 3:
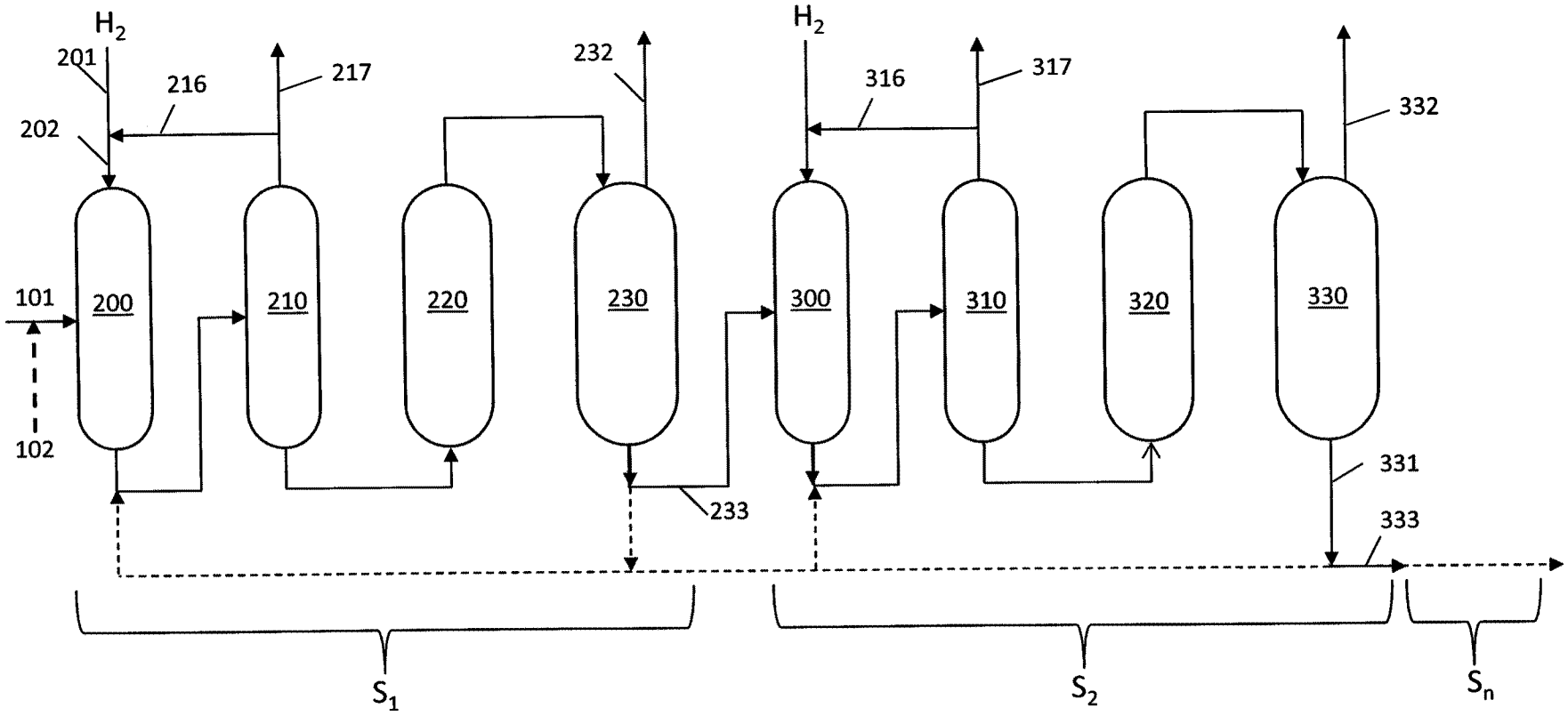
FIG. 3 is a schematic diagram illustrating a system comprised of a number of moving bed reactors arranged in series in accordance with the present disclosure.

Referring now to FIG. 3, a series of moving bed reactor systems S1, S2 . . . $S_n$ are shown, each system S comprises a mixing zone, a flashing zone, a reaction zone and a separation zone. Representative reactor system S1 includes a mixing zone 200 for dissolving hydrogen in make-up stream 201 and recycled hydrogen stream 216 as combined stream 202 with fresh feedstock 101 and an optional recycle stream 102 of treated and unconverted feedstock from one or more upstream reactors 220, 320, etc. Reactor system S1 includes flashing zone 210 and moving bed reaction zone 220 which can include the apparatus and method of operation that is substantially the same as the system described above in conjunction with FIGS. 1 and 2. The effluent from reaction zone 220 is introduced into separation zone 230 from which the converted lower boiling hydrocarbon products 232 are recovered and the higher boiling treated and unconverted liquid hydrocarbon feedstock 233 are recovered as bottoms for recycling in whole or part and/or transferred for downstream processing.

As will be understood from the illustration of system S2 in FIG. 3, all or a portion of stream 233 used as the feedstock for system S2 which generally includes the same type of unit operations that are identified by the corresponding 300 series of numbers. Additional moving bed reactor systems identified generally as $S_n$ can be included in the series. In each case, a portion of the treated and unconverted feedstock recovered from the respective separators, e.g., 331, can be recycled to one or more of the upstream mixing zones, e.g., 200, 300, for further hydrotreating. It will also be understood that a portion of the gases recovered from the flash units, e.g., 210, 310, containing a substantial proportion of hydrogen is recycled to one or more of the mixing zones in the series.

The use of a series of reactors, e.g., from two to four or six reactors, will greatly improve the recovery of lighter, more valuable hydrocarbons from heavy feedstocks in a system that permits easy replenishment of catalyst without taking any of the reactors out of service and interrupting production. In certain embodiments, the number or reactors in the series of reactors is greater than six.

The feedstock for the present system and process can include heavy hydrocarbon liquid residue feedstocks with a high concentration of metals and feeds with high Conradson Carbon Residue (CCR) values. The feedstocks can have a boiling point above 370° C., and in certain embodiments above 520° C.

Feedstocks that can serve as an additional source of hydrogen include straight run distillates and other intermediate refinery streams such as petroleum based oils such as atmospheric residue or vacuum residue or vacuum gas oil, deasphalted oil and/or demetallized oil obtained from a solvent deasphalting process, coker oils obtained from a coking process, cycle oils obtained from an FCC process, oils obtained from a visbreaking process, synthetic oils derived from coal liquefaction processes, bitumen and/or tar sand oils, oils from renewable sources, or any combination of the foregoing partially refined oil products. These feeds are known to contain hydrogen donor molecules, such as tetralin and can therefore serve as an additional source of hydrogen to the system, the presence of which can be predetermined by appropriate analytic procedures known in the art. The presence of hydrogen donor molecules can be relied upon to control the amount of make-up and recycle hydrogen introduced into the system, to thereby further improve the efficiency and economic operation of the system.

As is shown in FIGS. 1-3, the hydrogen-enriched hydrocarbon feedstock can be introduced into the bottom of the reactor to flow counter-currently to the downward movement of the catalyst. In other alternative embodiments, the hydrogen-enriched hydrocarbon feedstock can be introduced at the top of the reactor to flow concurrently with the downward movement of the catalyst.

In general, the operating conditions for the hydrocracking zone include a pressure in the range of from 50-300 Kg/cm$^2$, in certain embodiments 100-250 Kg/cm$^2$, and in further embodiments 150-200 Kg/cm$^2$; a temperature in the range of from 300° C.-550° C., in certain embodiments from 350° C.-500° C., and in further embodiments 350° C.-450° C.; a hydrogen-to-feed ratio of up to about 2500 lt/lt, in certain embodiments 100 to 2500 lt/lt, and in other embodiments 200 to 500 lt/lt; a liquid recycle-to-feed oil ratio in the range of from 1:1-1:10; and a liquid space velocity in the range of from 0.2-2.0 volume of feed per hour per volume of reactor ($V_f/h/V_r$).

Using the mixing zone and flashing zone described above, a functionally effective amount or concentration of hydrogen can be dissolved in the liquid hydrocarbon feedstock. In general, the amount of hydrogen dissolved in the feedstock depends on various factors, including the operating conditions of the mixing zone and the flashing zone, and the boiling point of the feed. It is known to those skilled in the art that hydrogen is more soluble in the lower boiling point, relatively lighter hydrocarbon fractions than in the heavier fractions. In the practice of the process of the present invention, the pre-determined operating conditions of temperature and pressure in the moving bed reactor are important and limiting of the upper range of the amount of hydrogen that can be dissolved in the feedstream. It will also be understood that some hydrogen gas, e.g., 1-2 V % may remain and be passed with the hydrogen-enriched feed due to the practical limitations of the industrial scale separation capability of the flashing unit.

According to the present process and system, the use of the hydrogen-enriched hydrocarbon feedstock that contains all or a substantial portion of the hydrogen required to achieve efficient hydroprocessing reactions as the hydrogen-enriched feedstock passes through the moving bed reactor, also eliminates or significantly reduces problems associated with excess gas in the system. For example, since excess hydrogen gas in the system is minimized or substantially eliminated, the reactor effluent stream and the bottoms stream have a reduced gas phase volume compared to conventional moving bed hydroprocessing systems, which will increase the efficiency and minimize the size and/or complexity of the downstream gas separation equipment. This is particularly so when the moving bed reactor bottoms are utilized as a recycle stream. The reduced levels of excess hydrogen also minimize the likelihood of gas hold-up and maximize liquid hold-up, resulting in increased liquid-catalyst contacting efficiency and catalyst wetting. A further advantage is that the reactor design can be simplified and thereby made more cost effective by eliminating or significantly reducing the gas phase.

Based on the operational characteristics of the system, the unconverted stream can be tested to determine the remaining level of dissolved hydrogen. If the predetermined minimum level of dissolved hydrogen remaining in the unconverted stream is met, it can be recycled directly to the reaction zone. If there is an insufficient concentration of dissolved hydrogen remaining in the unconverted stream, it can either be recycled to the system upstream of the mixing zone or with supplemental hydrogen introduced into the recycle steam, e.g., via an in-line mixing device (not shown) at a predetermined flow rate to saturate the stream, and then passed to the reactor.

Example 1

A vacuum residue derived from Arabian heavy crude oil was hydroprocessed in a moving bed hydrocracking unit at a temperature of 427° C., a hydrogen partial pressure of 200 bars, and 0.25 liter of oil per liter of reactor volume. The hydrogen gas stream was introduced into the top of the reactor, and the vacuum residue was introduced into the top of the reactor for concurrent flow with the hydrogen through the moving bed of catalyst, i.e., a three-phase system. Unconverted oil was recycled with a recycle oil-to-feedstock ratio of 5:1. The composition and properties of the oil before hydrotreating are shown in Table 1.

TABLE 1

| Properties | Units | Value |
|---|---|---|
| Specific Gravity | g/cm$^3$ | 1.04 |
| API Gravity | ° | 4.6 |
| Sulfur | W % | 5.73 |
| Nitrogen | W % | 0.47 |
| Ni and V | ppmw | 46/105 |
| CCR | W % | 24 |

The results showing the material balance of the products is shown in Table 2.

TABLE 2

| Component | Stream 110 | Stream 116 | Stream 112 | Stream 120 | Stream 128 | Stream 118 | Stream 132 | Stream 174 | Stream 177 |
|---|---|---|---|---|---|---|---|---|---|
| Hydrogen (kg) | | 93 | 381 | 381 | 288 | 288 | 93 | | |
| $H_2S$ (kg) | | | | — | | | | 510 | |
| $NH_3$ (kg) | | | | — | | | | 30 | |
| $CH_4$ (kg) | | | | — | | | | 85 | |
| $C_2H_6$ (kg) | | | | — | | | | 86 | |
| $C_3H_8$ (kg) | | | | — | | | | 150 | |
| $C_4H_{10}$ (kg) | | | | — | | | | 120 | |
| $C_5$-180° C. (kg) | | | | — | | | | 810 | |
| 180-240° C. (kg) | | | | — | | | | 537 | |
| 240-370° C. (kg) | | | | — | | | | 1,634 | |
| 370-520° C. (kg) | 900 | | | 900 | | | 900 | 2,340 | |
| 520 + ° C. (kg) | 9,100 | | | 48,000 | | | 48,000 | | 38,900 |
| Total (kg) | 10,000 | 93 | 381 | 49,281 | 288 | 0 | 48,993 | 6,302 | 38,900 |

The total conversion of the hydrocarbons boiling above 520° C. was found to be 69.3 W % of the starting material, and 82 W % hydrodesulfurization was achieved in the process. As indicated, 98 W % of the total metals initially in the feed were removed.

Example 2

A quantity of the same starting vacuum residue that was treated in Example 1 was hydroprocessed in a moving bed hydrocracking unit. Hydrogen was dissolved in the feedstock and unconverted recycle oil to provide a two-phase operating system. In order to obtain the same conversion as in Example 1, i.e., where the total conversion of the hydrocarbons boiling above 520° C. was 69.3 W % of the starting material, and 82 W % hydrodesulfurization was achieved in the recovered product stream, it was possible to operate at a lower temperature of 420° C. at the same hydrogen partial pressure of 200 bars in the reaction zone, with 0.25 liter of oil per liter of reactor volume. The recycle oil-to-feedstock oil ratio was 5:1.

When hydrogen is dissolved in the feedstock and the gas-phase hydrogen is substantially eliminated, a 30-40 V % reduction of the reactor volume that otherwise would have been occupied with gas hold-up in a three-phase system of the prior art is achieved. This reduction in gas hold-up volume permits either a reduction in designed reactor size for a given through-put in new facilities with an attendant capital cost savings, or a greater throughput for an existing reactor.

The two-phase system of Example 2 also resulted in an increase in the liquid present, in this example an increase of 30 V %. In the three-phase system, there was 40 V % of gas-phase hold up, which is the percentage of void fractions between the catalyst particles. In the two-phase system, there was 10 V % of gas-phase hold up.

The increase in liquid hold-up effects several process and reactor design parameters leading to improved efficiencies, including hydrocarbon conversion and heteroatom removal, or being able to achieve the same performance at lower operating temperatures. When the hydrogen is dissolved in the feedstock, the pressure drop in the reactor would increase slightly. In order to maintain a target pressure drop, this effect was compensated for by increasing the reactor diameter. The increased liquid hold-up in Example 2 increased contacting efficiency between the hydrogen-enriched liquid hydrocarbon and catalyst thus increasing the efficiency of the hydrocracking process.

Additionally, the required operating temperature to achieve the same degree of conversion was 420° C., i.e., 7° C. lower than employed in the three-phase system.

A recycle compressor that was required for Example 1 due to the gas in the system was replaced with a recycle pump in Example 2. As will be apparent to one skilled in the art, a gas compressor is more expensive than a recycle pump. Eliminating hydrogen in the gas phase therefore results in a substantial cost savings for process equipment.

The method and system of the present invention have been described above and in the attached drawings from which modifications will be apparent to those of ordinary skill in the art, and the scope of protection of the invention is to be determined by the claims that follow.

The invention claimed is:

1. A process for converting a liquid hydrocarbon feedstock into lower molecular weight hydrocarbon compounds in a moving bed reactor, the process comprising:

a. mixing the liquid hydrocarbon feedstock and an excess of hydrogen gas in a mixing zone under predetermined conditions of temperature and hydrogen partial pressure to dissolve a portion of the hydrogen gas in the liquid hydrocarbon feedstock and produce a mixture of hydrogen-enriched liquid hydrocarbon feedstock and undissolved hydrogen gas;

b. introducing the mixture produced in step (a) into a flashing zone to separate the undissolved hydrogen gas and any light hydrocarbon components present from the hydrogen-enriched hydrocarbon feedstock, the flashing zone being operated under predetermined conditions of temperature and pressure corresponding to those in a downstream reaction zone, and recovering the hydrogen-enriched liquid hydrocarbon feedstock;

c. introducing the hydrogen-enriched liquid hydrocarbon feedstock into the reaction zone of at least one moving bed reactor containing at least one catalyst or catalyst precursor under reaction conditions that are predetermined containing respect to the hydrocarbon feedstock, and reacting the feedstock and hydrogen exothermally to convert at least a portion of the feedstock into lower boiling hydrocarbons;

d. recovering a reactor effluent from the at least one moving bed reactor comprising converted hydrocarbon products and unconverted liquid feedstock;

e. introducing the reactor effluent from the at least one moving bed reactor into a separation zone to separate converted hydrocarbon products from unconverted liquid feedstock;

f. recovering the converted hydrocarbon products from the separation zone; and g. recovering the unconverted liquid feedstock from the separation zone.

2. The process of claim 1 in which at least a portion of the unconverted liquid feedstock recovered from the separation zone is recycled to the reaction zone to form a portion of the hydrogen-enriched liquid hydrocarbon feedstock.

3. The process of claim 2 in which the unconverted liquid feedstock is analyzed to confirm the presence of a predetermined minimum concentration of dissolved hydrogen prior to being recycled to the reaction zone.

4. The process of claim 2 in which hydrogen is added to the unconverted recycle liquid feedstock prior to its reintroduction into the reaction zone.

5. The process of claim 1 in which the hydrogen is added to saturate the liquid feedstock entering the reaction zone.

6. The process of claim 1 in which the at least one catalyst is a solid heterogeneous catalyst having an average particle size ranging from 0.6 mm to 2.5 mm.

7. The process of claim 1 in which an oil soluble homogeneous catalyst is added to the liquid hydrocarbon feedstock.

8. The process of claim 1 in which fresh oil soluble homogeneous liquid catalyst is added to the unconverted liquid feedstock upstream of one or more of the at least one reactors.

9. The process of claim 1 in which the reaction zone includes a plurality of moving bed reactors arranged in series, each reactor optionally preceded by a hydrogen mixing zone in which an excess of hydrogen is added to the recycled unconverted liquid effluent from an upstream reactor and a flashing zone to separate light components and undissolved hydrogen and passing an unconverted hydrogen-enriched liquid hydrocarbon feedstock to a downstream reactor.

10. The process of claim 9 in which the unconverted recycled liquid hydrocarbon feedstock is saturated with hydrogen.

11. The process of claim 8 in which a predetermined amount of fresh heterogeneous catalyst is added to the plurality of moving bed reactors during the processing of the hydrogen-enriched or saturated feedstock.

12. The process of claim 11 which is continuous and in which fresh catalyst is added to the plurality of reactors during the continuous operation of the process.

13. The process of claim 1, wherein a portion of the catalyst is removed from the moving bed reactor with the unconverted liquid recycle stream and separated from the liquid recycle stream prior to further processing of the recycle stream.

14. The process of claim 1, wherein the liquid hydrocarbon feedstock has a boiling point above 370° C.

15. The process of claim 12, wherein the liquid hydrocarbon feedstock in step (a) comprises one or more of straight run distillates and other intermediate refinery streams as an additional source of hydrogen absorbing liquids.

16. The process of claim 1, wherein the reaction zone comprises two or more moving bed reactors.

17. The process of claim 1, wherein the converted hydrocarbon products are full range or narrow range products comprising naphtha, middle-distillates, gas oils or residues.

18. The process of claim 1, wherein the at least one catalyst is selected from catalysts comprising at least one active metal from Periodic Table groups VI, VII and VIIIB, or IUPAC Groups 6-10, on a support of alumina, silica-alumina, silica, titania, magnesia or zeolites.

19. The process of claim 18, wherein the at least one catalyst is selected from the group comprising cobalt, nickel, molybdenum and tungsten.

20. The process of claim 18, wherein the at least one catalyst comprises active metals in the range of from 0.1W % to 30 W % based on the total weight of the catalyst.

* * * * *